United States Patent [19]

Williams

[11] 4,298,060

[45] Nov. 3, 1981

[54] FLUID JACKET FOR A VESSEL

[75] Inventor: Tecwyn L. Williams, Cowes, England

[73] Assignee: Elliott Turbomachinery Limited, England

[21] Appl. No.: 66,121

[22] Filed: Aug. 13, 1979

[30] Foreign Application Priority Data

Feb. 14, 1979 [GB] United Kingdom ..... 5218/79

[51] Int. Cl.[3] ..... F28F 3/12

[52] U.S. Cl. ..... 165/169; 165/170

[58] Field of Search ..... 165/169, 170, 166

[56] References Cited

U.S. PATENT DOCUMENTS

| | | | |
|---|---|---|---|
| 1,782,234 | 11/1930 | Hofmann | 165/170 |
| 2,371,144 | 3/1945 | Bronander | 165/169 |
| 3,280,903 | 10/1966 | Stoddard | 165/169 |
| 3,318,376 | 5/1967 | Vihl | 165/169 |
| 3,384,163 | 5/1968 | Pagdin et al. | 165/169 |
| 3,410,544 | 11/1968 | Beck | 165/169 |
| 3,464,488 | 9/1969 | Marmsater | 165/170 |
| 3,517,732 | 6/1970 | Brebant | 165/169 |
| 3,615,238 | 10/1971 | Bentley | 165/169 |
| 4,184,543 | 1/1980 | Kleine et al. | 165/170 |
| 4,205,720 | 6/1980 | Epstein | 165/169 |

*Primary Examiner*—Daniel J. O'Connor

*Attorney, Agent, or Firm*—J. Raymond Curtin; Frank N. Decker, Jr.

[57] ABSTRACT

A fluid jacket for a vessel includes a plurality of strips of relatively thin sheet material provided in spaced relation about the exterior surface thereof for defining the exterior surface of the fluid jacket. Each of the strips includes relatively small deformed portions spaced about the surface thereof and extending generally radially inward toward the exterior surface of the vessel. The inner end of each deformed surface is in contact with and affixed to the exterior surface of the vessel. The interior surface of the strips of material and the exterior surface of the vessel define therebetween at least one fluid flow channel for the fluid jacket.

3 Claims, 5 Drawing Figures

FLUID JACKET FOR A VESSEL

BACKGROUND OF THE INVENTION

This invention relates to fluid jackets and to a method of forming same.

Vessels such as storage tanks, mixing vats, reactors, kettles, conveyor troughs, pressure containers and the like are frequently required to be heated or cooled or to be held at a constant temperature. In many instances the heating or cooling is carried out by pumping or drawing a heating or cooling medium through a jacket space formed between the external wall or walls of the vessel and a fluid jacket spaced from the external wall or walls of the vessel.

Fluid jackets for vessels as aforesaid are frequently required to withstand high internal fluid pressures and for this reason are generally formed from heavy gauge sheet material, e.g., sheet steel of 8 mm. thickness or above, to provide the necessary strength and rigidity. Such fluid jackets are usually formed by securing, e.g., welding, spacer blocks to the external surface of the vessel and then securing, e.g., welding, the heavy gauge sheet material to the spacer blocks, suitable baffles being interposed if desired or necessary between the external surface of the vessel and the fluid jacket to provide a required pattern of fluid flow passages.

SUMMARY OF THE INVENTION

The object of the present invention is to provide a fluid jacket, and a method of forming same, which enables the fluid jacket to be formed from lighter gauge material, which is relatively inexpensive and simple to produce, and which eliminates the need for conventional spacer blocks.

The present invention provides a fluid jacket surrounding a vessel, the fluid jacket comprising sheet material having localized projections at spaced intervals over the entire area of the internal surface thereof, each of said projections being secured to the external surface of the vessel.

The present invention also provides a method of forming a fluid jacket surrounding a vessel, the method comprising obtaining sheet material having localized projections at spaced intervals over the entire area of what is to be the internal surface thereof, placing the sheet material so that said localized projections are in contact with the external surface of the vessel, and securing each of said localized projections to the external surface of the vessel.

Preferably said localized projections are formed by locally deforming the sheet material to produce indentations in the external surface of the sheet material and said projections on the internal surface thereof. The localized projections may be of any suitable form, although part-spherical or frusto-conical projections are preferred because when sheet material is locally deformed to produce such projections a pleasing dimpled appearance is imparted to the external surface of the fluid jacket.

Said projections may each be secured to the external surface of the vessel in any suitable manner, e.g., as by welding, bonding, riveting or brazing.

The size and spacing of said projections will depend upon a number of factors, such as the thickness and type of sheet material to be used and the fluid pressures to which the fluid jacket will be subjected and can readily be determined for any particular application, the main criteria being that the projections should be of a size and number such as not to unduly affect the flow of fluid through the jacket space while providing a sufficient number of points of attachment of the fluid jacket to the external surface of the vessel as to impart the necessary strength and rigidity to the fluid jacket.

The margins of the sheet material may be sealingly secured either to the external surface of the vessel and/or to adjacent sheets. For example, the sheet material may be in the form of strips of suitable width, the side margins of each strip being turned down to provide depending flanges which are secured to the external surface of the vessel or, alternatively, the side margins of the strips may be secured to upstanding flanges of angle members, the other flanges of which seat upon and are secured to the external surface of the vessel. In either case the height of said depending flanges or upstanding flanges should be substantially the same as the height of said projections. If desired internal baffles may be provided in known manner between the fluid jacket and the external surface of the vessel. By forming the fluid jacket from strips as aforesaid, securing the margins of the strips either to the external surface of the vessel or to a next adjacent strip and if necessary utilizing internal baffles, a fluid jacket can readily be produced which will provide a required pattern of fluid flow passages.

Because the fluid jacket is secured to the external surface of the vessel at each of said projections and because said projections can be spaced as required or necessary, it is possible to form the fluid jacket from thin sheet material, i.e., sheet material of less than 8 mm, in thickness. Such a fluid jacket can be of uniform thickness, is relatively inexpensive to manufacture as compared with conventional fluid jackets, and can be readily profile shaped to conform to the external surface of vessels of various configurations. Moreover, by suitable design of said projections, the spacing between the external surface of the vessel and the fluid jacket can be reduced to reduce the volume of heating or cooling medium required within the jacket without reducing the area of contact between the heating or cooling medium and the external surface of the vessel, whereby the reaction time for temperature changes will be reduced to provide more positive control, and safety will be enhanced due to the smaller volume of heating or cooling medium required to be used.

Generally the sheet material used for the fluid jacket will be sheet metal which can be welded or brazed to the external surface of the vessel, care being taken to ensure by suitable field corrosion tests that the materials from which the external wall of the vessel and the fluid jacket are formed are compatible.

In known manner, either suitable insulating material may be provided around the fluid jacket or, if this is omitted, a safety screen e.g., of 12.7 mm. wire mesh may be provided around and spaced at least 50 mm. from the external surface of the fluid jacket.

BRIEF DESCRIPTION OF THE DRAWINGS

The invention will be more particularly described with reference to the accompanying drawings, in which.

DESCRIPTION OF THE PREFERRED EMBODIMENT

Figure 3:
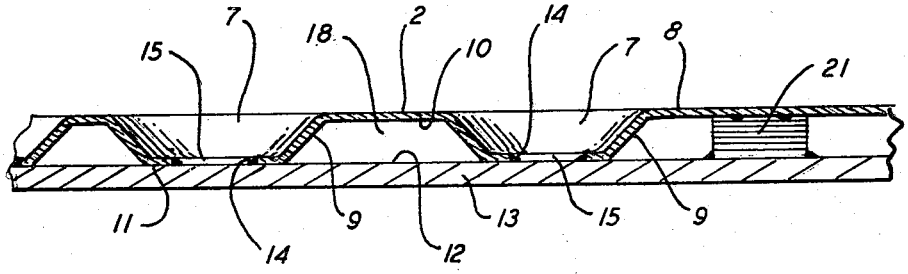
FIG. 3 is a developed view of a fragmentary enlarged cross-section through part of the external wall of the pressure vessel and fluid jacket shown in FIGS. 1 and 2 and FIG. 4 is a developed view of a fragmentary cross-section through another part of the external wall of the fluid pressure vessel and fluid jacket.

The combination illustrated comprises a spherical metal pressure vessel 1 having secured to the external periphery thereof a fluid jacket 2. Fluid jacket 2 is formed in two substantially hemispherical parts 3, 4 which are connected together by connecting lugs and bolts 5. Each part 3 or 4 of the fluid jacket 2 is formed from sheets 6 of thin metal, i.e., sheet metal having a thickness of less than 8 mm., which has been locally deformed at spaced intervals over the entire area of the surface thereof to form depressions 7 in the external surface 8 thereof and corresponding projections 9 on the internal surface 10 thereof, the projections 9 being substantially in the form of inverted truncated cones as shown in FIG. 3. The substantially flat base 11 of each projection 9 is in contact with external surface 12 of peripheral wall 13 of pressure vessel 1 and is secured thereto by a fillet weld 14 around the periphery of an aperture 15 formed in flat base 11, aperture 15 serving to facilitate the welding of projection 9 to external surface 12 of wall 13. Preferably sheets 6 of thin material are formed in a strip-like configuration; however, the sheets may be formed from material having other suitable shapes.

Figure 2:
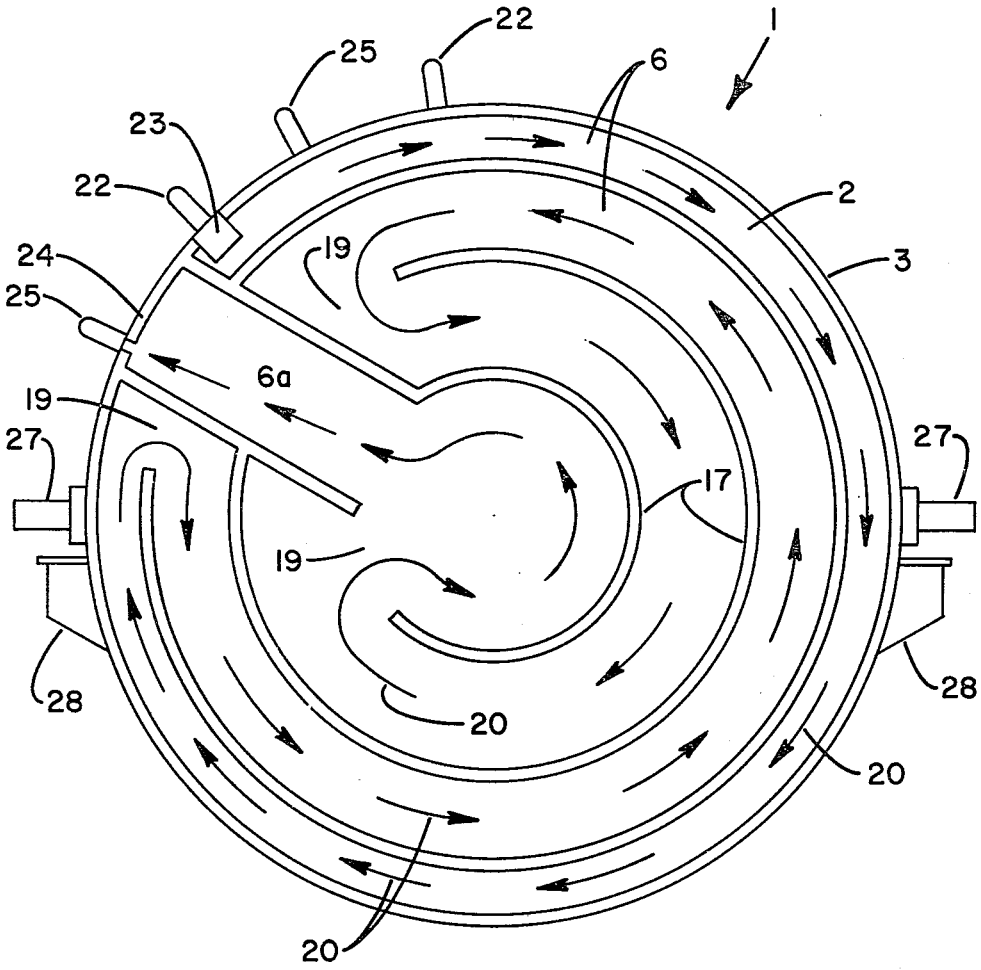
FIG. 2 is a diagramatic top plan view of the pressure vessel and fluid jacket combination shown in FIG. 1.
Figure 4:
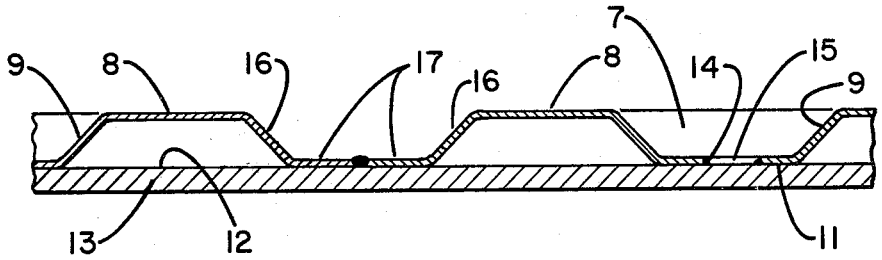
Figure 5:
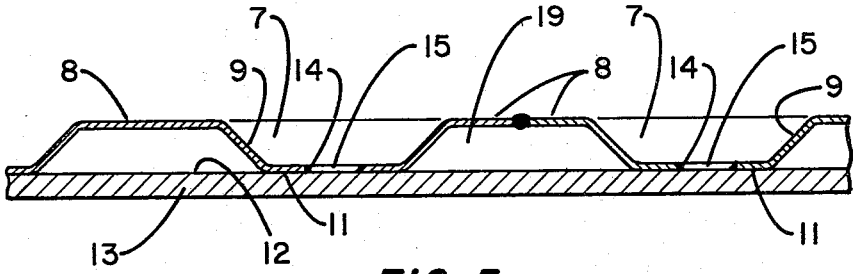
FIG. 5 is a developed view of a fragmentary cross-section through still another part of the external wall of the fluid pressure vessel and fluid jacket.

The longitudinal side margins of strips 6 are turned down to form depending flanges 16 of substantially the same height as projections 9 and are then turned out to form outwardly extending flanges 17 which are in contact with and are welded to the external surface 12 of the peripheral wall 13 of the pressure vessel 1 and shown in FIG. 4. Thus each strip 6 defines with the peripheral wall 13 of the vessel 1 a fluid flow channel 18 (FIG. 3). Where the channels 18 defined by adjacent strips 6 are required to communicate, as indicated at 19 in FIG. 2, to provide a required serpentine pattern of fluid flow channels, as indicated diagrammatically by arrows 20 in FIG. 2, flanges 16, 17 are omitted over that region 19 where communication is required and the adjacent side edges of the strips 6 are butt welded to one another. More particularly, a substantial portion of each longitudinally extending side of each sheet of material is turned radially inward towards and into contact with the exterior surface of the vessel, with the height of said inwardly turned sides being generally equal to the height of said deformed portions of said sheets of material, whereby each sheet of material defines a separate fluid flow channel in conjunction with the exterior surface of said vessel, as illustrated in FIG. 4. The remaining portion of each side from selected ones of said sheets of material extends outwardly towards a correspondingly outwardly extending portion from the side of an adjacent sheet of material, and the ends of said outwardly extending portions are joined together for defining with the exterior surface of said vessel a fluid flow passage for communicating a fluid flow channel defined by one sheet of material with the channel defined by the adjacent sheet of material, as illustrated in FIG. 5. The required pattern of fluid flow channels may further be defined by one or more internal baffles 21 (FIGS. 2 and 3) inserted between the fluid jacket 2 and the peripheral wall 13 of the pressure vessel 1.

Each of parts 3,4 of fluid jacket 2 has its own independant pattern of fluid flow channels 18 and each has a fluid inlet 22 communicating with an inlet header box 23 which in turn communicates with an inlet end of the intercommunicating fluid flow channels 18. Likewise the outlet end of the fluid flow channels 18 of each part 3,4 communicates with an outlet header box 24 to which is connected a fluid outlet 25.

Figure 1:
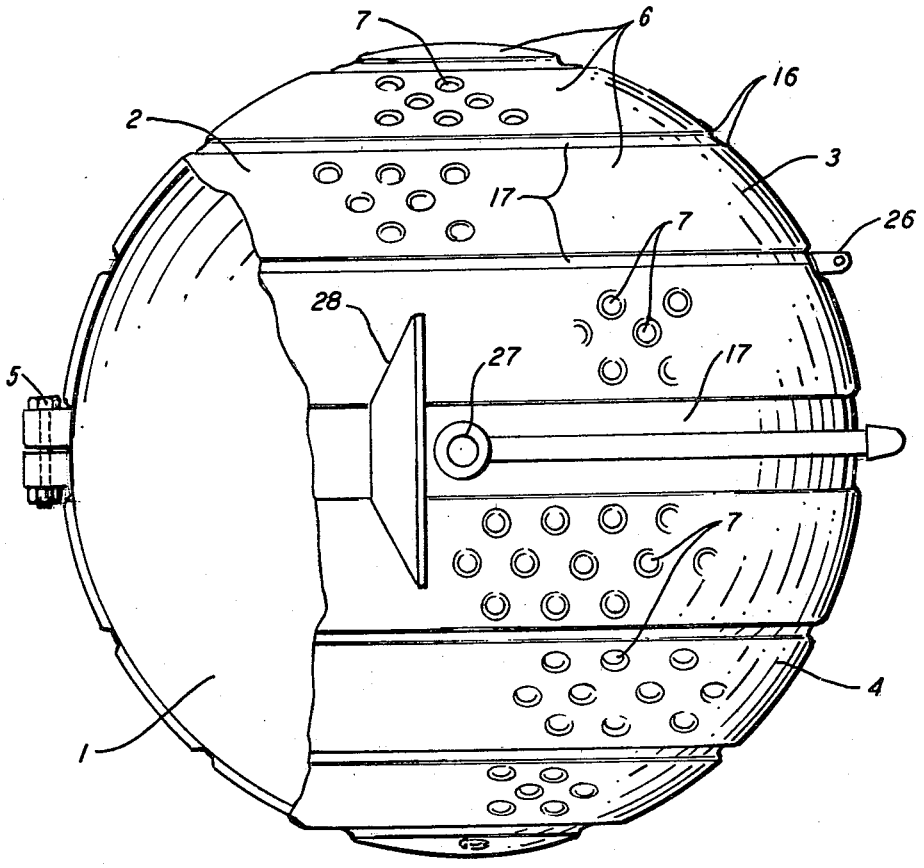
FIG. 1 is a side elevation of a spherical pressure vessel and fluid jacket combination according to the present invention.

In the illustrated embodiment each of the strips 6 is 254 mm. in width between depending flanges 16 with the exception of the outlet strip **6*a* (FIG. 2) which is 216 mm. wide. Each of the strips 6, with the exception of the outlet strip 6*a*, has three rows of depressions 7, and hence projections 9, extending longitudinally thereof, the spacing between centers of the depressions 7 in each row being not more than 102 mm., the spacing between lines extending through the centers of the depressions 7 in each row being 83 mm., and the depressions 7 in each row being intermediate the depressions 7 in the adjacent row or rows, all as shown in FIG. 1 where a few only of the depressions 7** are illustrated.

By suitably choosing the number and spacing of projections 9 so each projection 9 and fillet weld 14 is subjected to a tensile load not exceeding 910 kilogramme, or a tensile stress in the area of the fillet weld 14 not exceeding 52 Newtons per square millimeter, a fluid jacket 2 formed from 1.5 mm. steel sheet can be provided which will withstand internal fluid pressures of up to 17 Bar Gauge.

Pressure vessel 1 has one or more lifting lugs 26, a pair of diametrically opposed mounting pintles 27 and a pair of diametrically opposed mounting brackets 28 secured to the peripheral wall 13 thereof and the fluid jacket 2 is suitably shaped therearound.

Although not shown in the drawings, suitable insulating material or a suitable safety screen may be provided around the exterior of the fluid jacket 2 in known manner.

While a preferred embodiment of the present invention has been described and illustrated, the invention should not be limited thereto but may be otherwise embodied within the scope of the following claims.

I claim:

1. A heat exchange apparatus comprising a vessel having curved exterior surface and a fluid jacket disposed about the curved exterior surface of said vessel, said fluid jacket comprising a plurality of sheets of relatively thin, complimentarily curved, material disposed on the exterior surface of said vessel; each of said sheets having a plurality of relatively small depressions spaced about the surface thereof and extending generally radially inwardly into engagement with, and being sealingly secured to the exterior surface of said vessel, thereby defining a fluid flow channel between the exterior surface of said vessel and said sheets; at least portions of the edges of each of said sheets being turned generally radially inwardly into contact with and being sealingly secured to the exterior surface of said vessel; at least a portion of an edge of selected pairs of adjacent sheets extending outwardly and being sealingly secured to the corresponding adjacent edge portion of the other of said pairs of adjacent sheets to provide an interconnecting fluid flow channel for communicating the fluid flow channels and to provide a desired fluid flow path across the surface of said vessel; and said heat exchange apparatus having a fluid inlet passage and a fluid outlet passage for passing fluid to and from said fluid flow channels.

2. A heat exchange apparatus as defined in claim 1 wherein said sheets of material comprise a plurality of parallel elongated curved strips of material extending about substantially the entire curved circumferential surface of said vessel, said strips being spaced along an axis of said vessel; wherein said outwardly extending edge portions of said selected pairs of adjacent sheets are disposed on the elongated edges of said sheets adjacent the end portions thereof, to form a serpentine fluid flow path across the face of said vessel.

3. A heat exchange vessel as defined in either of claims 1 or 2 wherein said vessel is substantially spherical in shape.

* * * * *